US005656094A

United States Patent [19]

Peckous

[11] Patent Number: 5,656,094

[45] Date of Patent: Aug. 12, 1997

[54] INTEGRATED PROCESS FOR PRODUCING CRYSTALLINE FRUCTOSE AND A HIGH-FRUCTOSE, LIQUID PHASE SWEETENER

[75] Inventor: Larry W. Peckous, Decatur, Ill.

[73] Assignee: A.E. Staley Manufacturing Company, Decatur, Ill.

[21] Appl. No.: 747,818

[22] Filed: Aug. 20, 1991

Related U.S. Application Data

[62] Division of Ser. No. 294,946, Jan. 6, 1989, abandoned, which is a continuation of Ser. No. 103,624, Oct. 1, 1987, abandoned, which is a continuation-in-part of Ser. No. 9,432, Feb. 2, 1987, abandoned.

[51] Int. Cl.[6] ..... C13J 1/06; C13F 1/02; C13F 1/00

[52] U.S. Cl. ..... 127/461; 127/58; 127/61

[58] Field of Search ..... 127/46.1, 58, 61

[56] References Cited

U.S. PATENT DOCUMENTS

| | | | |
|---|---|---|---|
| 329,331 | 10/1885 | Matthiessen . | |
| 988,261 | 3/1911 | Griere | 127/58 |
| 1,228,910 | 6/1917 | Griere | 127/60 |
| 1,749,588 | 3/1930 | Kopke | 127/58 |
| 1,979,781 | 11/1934 | van Scherpenberg | 127/30 |
| 2,175,369 | 10/1939 | Wagner et al. | 127/58 |
| 2,263,704 | 11/1941 | Platte et al. | 127/58 |
| 2,354,664 | 8/1944 | Cantor et al. | 127/36 |
| 2,587,293 | 2/1952 | De Vries | 127/60 |
| 2,729,587 | 1/1956 | Koepsell et al. | 195/31 |
| 2,763,580 | 9/1956 | Zabor | 127/55 |
| 2,845,369 | 7/1958 | Davis et al. | 127/46 |
| 2,943,004 | 6/1960 | Haury | 127/58 |
| 3,039,935 | 6/1962 | Rentshler et al. | 195/11 |
| 3,044,904 | 7/1962 | Serbia | 127/46 |
| 3,044,905 | 7/1962 | Lefevre | 127/46 |
| 3,247,021 | 4/1966 | Steele et al. | 127/15 |
| 3,383,245 | 5/1968 | Scallet et al. | 127/53 |
| 3,431,253 | 3/1969 | Parrish | 260/209 |
| 3,432,345 | 3/1969 | Tsao et al. | 127/42 |
| 3,505,111 | 4/1970 | Malek | 127/16 |
| 3,513,023 | 5/1970 | Kusch et al. | 127/58 |
| 3,540,927 | 11/1970 | Niimi et al. | 127/30 |
| 3,582,399 | 6/1971 | Black | 127/58 |
| 3,607,392 | 9/1971 | Lauer et al. | 127/15 |
| 3,619,293 | 11/1971 | Niimi et al. | 127/30 |
| 3,684,574 | 8/1972 | Katz et al. | 127/46 A |
| 3,690,948 | 9/1972 | Katz et al. | 127/46 A |
| 3,692,582 | 9/1972 | Melaja | 127/46 A |
| 3,704,168 | 11/1972 | Hara et al. | 127/58 |

(List continued on next page.)

FOREIGN PATENT DOCUMENTS 2133796 of 0000 United Kingdom ..... C13K 11/00

OTHER PUBLICATIONS

P.H. Blanchard et al., "Production of High Fructose Corn Syrup in the USA", *Sugar Technology Reviews*, vol. 11, pp. 1–93 (R.A. McGinnis et al. eds., Elsevier, 1984) month N/A.

Kirk–Othmer, *Encylopedia of Chemical Technology*, vol. 22, pp. 499–522 (John Wiley & Sons, N.Y., N.Y., 3d ed., 1983) month N/A.

Kirk–Othmer, *Encyclopedia of Chemical Technology*, vol. 21, pp. 878, 891, 901–903 (John Wiley & Sons, N.Y., N.Y., 3d ed., 1983) month N/A.

Kirk–Othmer, *Encyclopedia of Chemical Technology*, vol. 7, pp. 243–285 (John Wiley & Sons,3d ed., 1979) month N/A.

*Primary Examiner*—Glenn A. Caldarola
*Assistant Examiner*—Patricia L. Hailey
*Attorney, Agent, or Firm*—Arnold, White & Durkee

[57] ABSTRACT

An integrated process is disclosed which produces both crystalline fructose and a liquid-phase sweetener such as High Fructose Corn Syrup from a feed stream comprising dextrose. A portion of the dextrose in the feed stream is isomerized to fructose and the resulting dextrose/fructose stream is fractionated to produce a high fructose stream. A portion of the fructose in the high fructose stream is crystallized out and the mother liquor remaining after crystallization is blended with dextrose-containing streams to produce the liquid-phase sweetener.

4 Claims, 5 Drawing Sheets

U.S. PATENT DOCUMENTS

| | | | |
|---|---|---|---|
| 3,814,253 | 6/1974 | Forsberg | 219/97 |
| 3,816,175 | 6/1974 | Melaja | 127/60 |
| 3,826,905 | 7/1974 | Valkama et al. | 235/151.12 |
| 3,875,140 | 4/1975 | Barker et al. | 260/209 R |
| 3,883,365 | 5/1975 | Forsberg et al. | 127/60 |
| 3,928,052 | 12/1975 | Yamauchi | 127/61 |
| 3,928,062 | 12/1975 | Yamauchi | 127/60 |
| 3,928,193 | 12/1975 | Melaja et al. | 210/31 C |
| 3,929,503 | 12/1975 | Yamauchi | 127/58 |
| 3,956,009 | 5/1976 | Lundquist et al. | 127/62 |
| 3,981,739 | 9/1976 | Dmitrovsky et al. | 127/60 |
| 4,009,045 | 2/1977 | Petri | 127/16 |
| 4,049,466 | 9/1977 | Walon | 128/29 |
| 4,155,774 | 5/1979 | Randolph | 127/60 |
| 4,164,429 | 8/1979 | Mercier | 127/15 |
| 4,199,373 | 4/1980 | Dwivedi et al. | 127/60 |
| 4,199,374 | 4/1980 | Dwivedi et al. | 127/60 |
| 4,263,052 | 4/1981 | Bichsel et al. | 127/41 |
| 4,294,624 | 10/1981 | Veltman | 127/62 |
| 4,310,628 | 1/1982 | Leiser | 435/94 |
| 4,371,402 | 2/1983 | Kubota | 127/60 |
| 4,373,025 | 2/1983 | Neuzil et al. | 435/94 |
| 4,395,292 | 7/1983 | Katz et al. | 127/29 |
| 4,404,037 | 9/1983 | Broughton | 127/55 |
| 4,501,814 | 2/1985 | Schoenrock et al. | 435/94 |
| 4,502,890 | 3/1985 | Urbanic | 127/46.1 |
| 4,517,021 | 5/1985 | Schollmeier | 127/30 |
| 4,523,960 | 6/1985 | Otte | 127/46.2 |
| 4,543,330 | 9/1985 | Morimoto et al. | 435/110 |
| 4,643,773 | 2/1987 | Day | 127/30 |
| 4,666,527 | 5/1987 | Ito et al. | 127/60 |
| 4,681,639 | 7/1987 | Hinck | 127/30 |

INTEGRATED PROCESS FOR PRODUCING CRYSTALLINE FRUCTOSE AND A HIGH-FRUCTOSE, LIQUID PHASE SWEETENER

CROSS-REFERENCE TO RELATED APPLICATIONS

This application is a divisional application of application Ser. No. 07/294,946, filed Jan. 6, 1989, which is a continuation of application Ser. No. 07/103,624, filed Oct. 1, 1987, which is a continuation-in-part of application Ser. No. 07/009,432, filed Feb. 2, 1987, all now abandoned.

BACKGROUND OF THE INVENTION

1. Field of the Invention

This invention relates to edible sugars. More particularly, it relates to fructose obtained by the isomerization of dextrose. Of specific relevance is a process for the concurrent production of anhydrous crystalline fructose and a syrup consisting essentially of fructose and dextrose.

Also of specific relevance are a process of crystallizing fructose by cooling a solution of fructose such that differing levels of supersaturation are produced during different periods of crystal growth and a process for producing a purified and concentrated fructose syrup.

2. Background of the Invention

LIQUID-PHASE FRUCTOSE PRODUCTS

Fructose is a monosaccharide highly valued as a nutritive sweetener. The vast majority of fructose sold in this country is derived from corn starch with the principal form of the product being High Fructose Corn Syrup (HFCS). The syrups of commerce range from 42% to 90% by weight fructose on a dry solids basis (As used hereinafter, including the claims, "dsb" shall mean "by weight on a dry solids basis".) The remainder is predominately dextrose. The HFCS commonly used as a sucrose replacement in soft drinks typically comprises 55% fructose, 41% dextrose, and 4% higher saccharities (all percentages dsb). The solids content of such a syrup is usually about 77% by weight.

On an industrial scale, the production of HFCS commences with the enzymatic liquefaction of a purified starch slurry. The principal source of raw material in the United States is corn starch obtained by the wet milling process. However, starches of comparable purity from other sources can be employed.

In the first step of a typical process a starch slurry is gelatinized by cooking at high temperature. The gelatinized starch is then liquefied and dextrinized by thermostable alpha-amylase in a continuous two-stage reaction. The product of this reaction is a soluble dextrin hydrolysate with a dextrose equivalent (DE) of 6–15, suitable for the subsequent saccharification step.

Following liquefaction-dextrinization, the pH and temperature of the 10–15 DE hydrolysate is adjusted for the saccharification step. During saccharification the hydrolysate is further hydrolyzed to dextrose by the enzymatic action of glucoamylase. Although saccharification can be carried out as a batch reaction, a continuous saccharification is practiced in most modern plants. In the continuous saccharification reaction, glucoamylase is added to a 10–15 DE hydrolysate following pH and temperature adjustment. The carbohydrate composition of typical high -dextrose saccharification liquor is: 94–96% dextrose, 2–3% maltose; 0.3–0.5 maltotriose; and 1–2% higher saccharities (all percentages dsb). The product will typically be 25 to 37% dry substance. This high-dextrose hydrolysate is then refined to produce dextrose feedstock for the isomerization reaction.

Preparation of very high-quality dextrose feedstock for isomerization is necessary because of the very low color and ash specifications of the finished HFCS. A high-purity feedstock is also required for efficient utilization of the immobilized isomerase enzyme column.

Immobilized isomerase enzyme columns are used continuously over a period of several months. During this period very large volumes of dextrose feedstock pass through the columns. Extremely low levels of impurities such as ash, metal ions, and/or protein in the feedstock can accumulate and lead to decreased productivity of the enzyme. For these reasons dextrose feedstock is refined to a color of 0.1 (CRA×100) and a conductivity of 5–10 micromhos.

Carbon-treated, filtered, and deionized, high-dextrose liquor is evaporated to the proper solids level for isomerization. In addition, the feedstock is chemically treated by the addition of magnesium ions, which not only activate the immobilized isomerase, but also competitively inhibit the action of any residual calciums ions, which are potent inhibitors of isomerase.

The isomerization reaction, which converts some of the dextrose to fructose, is commonly carried out on a stream comprising 94–96% (dsb) dextrose and 4–6% (dsb) higher saccharities, at 40–50% dry substance. The stream has a pH of 7.5–8.2 at 25° C. and will be subjected to the action of the isomerase enzyme for ½ to 4 hours at 55°–65° C.

The conversion of glucose to fructose is a reversible reaction with an equilibrium constant of about 1.0 at 60° C. Thus, one would expect to obtain a fructose level of about 47–48% at equilibrium, starting from a feedstock continuing 94–96% dextrose. However, the reaction rate of the isomerization near the equilibrium point is so slow that it is prudent to terminate the reaction at a conversion level of about 42% fructose to achieve practical reactor residence times.

In a given isocolumn (immobilized isomerase column), the rate of conversion of dextrose (glucose) to fructose is proportional to the enzyme activity of the immobilized isomerase. This activity decays over time in a nearly exponential fashion. When the column is new and the activity is high, the flow of feedstock through the column is relatively high, since a shorter residence time is required to achieve the 42% fructose level. As the usage life of the column increases, the flow through the column must be reduced proportionately to provide a longer residence time, compensating for the lowered activity in order to achieve a constant conversion level.

In practice, parallel operation of multiple isocolumns is used to minimize production fluctuations with respect to capacity and conversion level. In this arrangement each isocolumn can be operated essentially independently of the others. The variation in total flow of the isocolumns must be maintained within relatively narrow limits because of the requirements of evaporation and other finishing operations In practice, flow cannot be precisely controlled at all times so as to obtain a 42% fructose stream, but this can easily be achieved on an average basis.

One of the most critical operating variables in such a process is the internal isocolumn pH. The operating pH is usually a compromise between the pH of maximum activity (typically around pH 8) and the pH of maximum stability (typically pH 7.0–7.5). This is complicated by the fact that the dextrose feedstock is not pH stable at temperatures around 60° C. Some decomposition occurs producing acidic by-products which results in a pH drop across the isocolumn during operation.

Following isomerization, the typical manufacturing process employs secondary refining or polishing of the 42% HFCS product. Some additional color is picked up during the chemical treatment and isomerization when the feedstock is held at a higher pH and temperature for a period of time. The product also contains some additional ash from the chemicals added for isomerization. This color and ash are removed by secondary carbon and ion exchange systems. The refined 42% HFCS is then typically evaporated to 71% solids for shipment.

The use of activated carbon to purify sugar syrups is generally known. U.S. Pat. No. 1,979,781 (van Sherpenberg) discloses mixing a raw sugar syrup (i.e., one not mixed with glucose syrup or with invert sugar syrup) at 60° Brix (60% dry solids) with 1 to 2% by weight activated carbon and heating to 134° C. for a short period of time. U.S. Patent No. 2,763,580 (Zabor) broadly discloses treatment of sugar liquors (e.g., cane, beet or corn sugars) having solids contents of between 10 and 60%, especially 20 to 56%, by weight at 125° to 200° F. with activated carbon. The patent discloses that partial treatment can be carried out at one concentration or condition, after which the treatment can be completed at a higher concentration (obtained by evaporation) or other condition.

Various patents directed to the production of corn syrups containing fructose incidentally disclose carbon-treatment and subsequent concentration of aqueous solutions having varying fructose concentrations (dsb) and varying levels of dry solids. U.S. Pat. Nos. 3,383,245 (Scalier et al.) and 3,690,948 (Katz et al.) disclose carbon-treating fructose containing syrups having about 20% (dsb) fructose at about 40% dry solids and subsequently concentrating the syrups (e.g., by evaporation to 70–83% dry solids), U.S. Pat. No. 3,684,574 (Katz et al. ) discloses carbon-treatment of a syrup containing about 20% (dsb) fructose at a dry solids as low as 20% dry solids and subsequent concentration of the syrup. U.S. Pat. No. 4,395,292 (Katz et al.) discloses feeding a carbon-treated mixture of fructose and dextrose having from 10 to 70% dry solids, preferably 40%, to a fractionating column and concentrating the fructose containing extracts. The '292 patent discloses that extracts containing over 90% fructose can be obtained and discloses an example (Example No. 7) wherein a 40% dry solids feed was fractionated to produce a fraction having 100% (dsb) fructose at 9% dry solids.

The HFCS product from the isomerization reaction typically contains 4:2% fructose, 5:2% unconverted dextrose, and about 6% oligosaccharides. For reasons previously discussed, this product represents the practical maximum level of fructose attainable by isomerization. In order to obtain products with higher levels of fructose, it is necessary to selectively concentrate the fructose. Many common separation techniques are not applicable for this purpose, since they do not readily discriminate between two isomers of essentially the same molecular size. However, fructose preferentially forms a complex with different cations, such as calcium. This difference has been exploited to develop commercial separation processes.

There are basically two different commercial processes currently available for the large-scale purification of fructose. In both instances, resins in the preferred cationic form are used in packed bed systems. One process employs an inorganic resin leading to a selective molecular absorption of fructose (see, R. J. Jensen, "The Sarex Process for the Fractionation of High Fructose Corn Syrup," Abstracts of the Institute of Chemical Engineers, 85th National Meeting, Philadelphia, Pa., 1978).

Chromatographic fractionation using organic resins is the basis for the second commercial separation process (see, K. Venkatasubramanian, "Integration of Large Scale Production and Purification of Biomolecules," *Enzyme Engineering,* 6:37–43, 1982). When an aqueous solution of dextrose and fructose (e.g., 42% HFCS) is fed to a fractionating column, fructose is retained by the resin to a greater degree than dextrose. Deionized and deoxygenated water is used as the eluent. Typically, the separation is achieved in a column packed with a bed of low crosslinked, fine-mesh, polystyrene sulfonate cation exchange resin using calcium as the preferred salt form. The enriched product which contains approximately 90% fructose is referred to as Very Enriched Fructose Corn Syrup (VEFCS). This VEFCS fraction can be blended with the 42% HFCS feed material to obtain products having a fructose content between 42% and 90%. The most typical of these products is 55% Enriched Fructose Corn Syrup, which is sometimes referred to as EFCS or 55 EFCS. U.S. Pat. No. 4,395,292 (Katz et el.) discloses an example (Example No. 1 ) of fractionating a mixture of fructose and dextrose into various fractions and combining fructose-enriched fractions to produce a syrup containing 55.8% (dsb) fructose. This same example also discloses single fractions having high concentrations (dsb) of fructose (e.g., 75.1% (dsb)) and discloses combining fractions containing lesser concentrations of fructose (e.g., 64.5% (dsb) with 58.2% (dsb) fructose).

The treatment of other raffinate streams in the fractionation process is an important consideration. In general, the dextrose-rich raffinate stream is recycled to the dextrose feed of the isocolumn system for further conversion to 42% HFCS. A raffinate stream containing dextrose and fructose and having a fructose level higher than that of the feed stream can be recycled through a fractionator to maintain a high solids level and to reduce water usage. A raffinate stream rich in oligosaccharides can be recycled to the saccharification system.

Since water is used as the elution media, it has a great impact on the overall evaporation load on the system. Very low solids concentrations increase the risk of microbial contamination within the system. Thus, the most important design parameter dictating overall process economics is the maximization of solids yield at acceptable purity while minimizing the dilution effect of the eluant rinse. The efficiency of feed and water usage must be maximized for optimal yield. The yield is important to reduce the cost of reisomerization.

Procedures available for achieving these goals include recycling techniques, higher equalization of the resin phase with proper redistribution in a packed column, and the addition of multiple entry and exit points in the column. These approaches can be used to increase the purity and the yield.

In a batch fractionation system, a small apparent increase in the purity of feed to the fractionating column, that is, higher fructose levels, results in a much larger gain in production through increased yield at a given product purity. In practice, this translates into maximization of the ratio of the sugar volume fed per volume of resin per cycle, minimization of the ratio of the water column required per volume of resin per cycle, and careful fluid distribution to the columns.

SOLID-PHASE FRUCTOSE PRODUCTS

A number of processes are known for crystallizing fructose. For example, crystalline fructose may be prepared by adding absolute alcohol to the syrup obtained from the acid hydrolysis of inuline (Bates et al., Natl. Bur. Std. Cite. C440.399, 1942). The preparation of fructose from dextrose is described in U.S. Pat. No. 2,354,664 and U.S. Pat. No. 2,729,587 describes its preparation from sucrose by enzymatic conversion.

Fructose forms orthorhombic, bisphenoidal prisms from alcohol which decompose at about 103°–105° C. Hemihydrate and dihydrate crystalline forms are also known, but it is preferable to avoid the formation of these species inasmuch as they are substantially more hygroscopic than the anhydrous form and have melting points close to room temperature. These properties make these crystalline forms of fructose very difficult to handle.

Solvent Crystalline Fructose (SCF) is prepared by a process wherein an organic solvent, such as denatured ethyl alcohol, is mixed with a high-fructose stream (95% dsb). This stream crystallizes as it is cooled to form pure crystalline fructose. The product is centrifuged to separate it from the mother liquor, desolventized, and dried.

U.S. Pat. No. 4,199,374 describes a process for producing SCF. Fructose is crystallized from a solution of VEFCS in ethanol. The solution is seeded with fine crystals of fructose or glucose. The crystals are harvested by filtration, centrifugation or other suitable means. These crystals are then washed with alcohol and dried under vacuum. The moisture content of the alcohol and syrup must be carefully controlled in this process in order to obtain free-flowing fine crystals of fructose.

It is also possible to simply produce a dried fructose sweetener (DFS). In a DFS process, a high fructose stream derived from fractionation is dried in a rotary dryer, then sized in a classifier containing screens and grinders. U.S. Pat. No. 4,517,021 describes the preparation of such a granular, semi-crystalline, solid fructose which comprises less than about 2% water by weight. The patent discloses that about 60 weight percent of the product is crystalline fructose, and less than 35 weight percent is amorphous fructose. A drum dryer is used, with air having an initial temperature of 50°–80° C. A portion of the solid fructose product may be recycled as the crystallization initiator.

One disadvantage of a DFS process is that the product cannot be called pure fructose because it is a total sugar product and does not meet the Food Chemicals Codex criteria for "fructose." Moreover, since it is not completely crystalline, it is more hygroscopic and thus harder to handle in humid conditions than crystalline fructose.

An aqueous process can also be used to produce crystalline fructose. An aqueous crystalline fructose process typically starts with a high fructose feed stream which is cooled to crystallize the fructose from solution. A number of references describe such a process.

In U.S. Pat. No. 3,513,023 crystalline, anhydrous fructose is obtained from an aqueous solution of fructose (min. 95% ds). The pH of the solution must be between 3.5 and 8.0. The fructose solution is concentrated under vacuum until the water content is between 2 and 5%. The solution is cooled to 60°–85° C., seeded with crystalline fructose, and stirred vigorously while the temperature is maintained at 60°–85° C. The patentee states that a crystalline mass results which, after slow cooling, can be crumbled or ground and subsequently dried to produce a non-sticking, free-flowing, finely-crystalline powder. The process is said to avoid the formation of the glass phase product which ordinarily results when fructose solutions of this type are concentrated in a vacuum and allowed to cool in the usual manner.

In U.S. Pat. No. 3,883,365 fructose is crystallized from an aqueous fructose/glucose solution of 90% ds and containing 90–99% (dsb) fructose. The solution is saturated (58°–65° C). The fructose is crystallized from the solution by adding fructose crystals of homogeneous size. The formation of new crystals is minimized by keeping the distances of the seed crystals from each other suitably short and maintaining the degree of supersaturation between 1.1 and 1.2. The volume of the solution is increased, either continuously or stepwise, as the crystallization proceeds. The optimum pH of the fructose solution is said to be 5.0. The crystals so obtained reportedly have an average crystal size between 200–600 microns. Centrifugation is used to separate the crystals from the solution.

U.S. Pat. No. 3,928,062 discloses that anhydrous fructose crystals are obtained by seeding a solution containing 83–95.5% (dry basis) total sugar comprising 88–99% fructose. Crystallization may be accomplished by simply cooling the solution under atmospheric pressure or by evaporating water under reduced pressure. Formation of the hemihydrate and dihydrate are avoided by carrying out the crystallization within a certain range of fructose concentrations and temperatures. This range lies within the supersaturation area below the point at which the hemihdyrate begins to crystallize out. It is said that the mother liquor may be used repeatedly for the crystallization of further crops in the same manner as the first crop without any additional treatment. The addition of seed crystals may be achieved using a form of massecuite which was previously prepared by suspending the crystals in the fructose solution.

In U.S. Pat. No. 4,199,373 crystalline fructose is produced by seeding a fructose syrup (88–96% dsb) with 2–15 weight percent fructose seed crystals and permitting the seeded syrup to stand at about 50° to 90° F. at a relative humidity below 70%. Crystallization is said to require 2 to 72 hours. The crystalline product produced by the process is in the form of large pellets.

U.S. Pat. No. 4,164,429 describes a process and apparatus for producing crystallization seeds. A series of centrifugal separations are employed to select seed crystals from the seeded solution which fall within a predetermined size range.

Crystallization Cooling Curves

The cooling of a saturated or supersaturated solution to crystallize material therefrom is, of course, generally known.

It is also known that the natural cooling of a saturated or supersaturated solution often results in severe nucleation which contributes to a potentially undesirably broad particle size distribution for the crystalline product. For example, the discussion of crystallization in the *Encyclopedia of Chemical Technology*, Vol. 7, pp. 243–285, (Kirk-Othmer, Ed. John Wiley & Sons, N.Y., 3rd ed., 1979), states that natural cooling results in a supersaturation peak early in the cooling period thus inducing heavy nucleation. The article teaches that by following a controlled cooling curve, a constant level of supersaturation can be maintained, thereby controlling nucleation within acceptable limits. FIG. 5 is a reproduction of the natural and controlled cooling curves published in this work.

SUMMARY OF THE INVENTION

The various aspects of this invention are briefly discussed below.

I. INTEGRATED, MULTIPLE, FRUCTOSE SWEETENER PRODUCTION

In one aspect, this invention broadly relates to the integrated production of a plurality of sweeteners which contain fructose.

A. Cocurrent Production of a Liquid-Phase Sweetener and Crystalline Fructose In a particular aspect, this invention relates to a process for producing crystalline fructose and a liquid-phase sweetener comprising fructose and dextrose which comprises:

crystallizing fructose in an aqueous solution of fructose to produce a mixture comprising crystalline fructose and mother liquor;

separating crystalline fructose from the mother liquor; and, mixing dextrose with the mother liquor to produce a liquid-phase sweetener comprising dextrose and fructose.

In the manufacture of crystalline sucrose from aqueous solution, it is common practice to take repeated, successive strikes of crystals to concentrate impurities in the mother liquor, referred to as molasses. This molasses is generally so impure that it has value only as an animal feed supplement or fermentation media. U.S. Pat. No. 3,928,062 teaches that the mother liquor from fructose crystallization can be used repeatedly for crystallization of further crops of fructose crystals. The comparatively low yield of fructose crystals from a single strike of crystals using common crystallization techniques and the difficulties associated with isomerizing and fractionating corn syrups to obtain a crystallizer feed having a high concentration of fructose makes the recycle of mother liquor by taking of successive strikes of fructose crystals appear desirable. However, the integration of the production of crystalline fructose with a liquid-phase sweetener by adding dextrose to the mother liquor allows one to obtain two premium quality sweeteners. This in turn allows one to maximize the yield of fructose useful as a sweetener and thereby justify the difficulty of isomerization. This process does, however, entail a sacrifice of gains made in fractionation in that the whole point of fractionation is to remove dextrose to prepare a crystallizer feed and thus the addition of dextrose to the mother liquor sacrifices part of the enrichment achieved through fractionation.

In a particular embodiment of this aspect of the invention, this invention relates to a process for producing crystalline fructose and a stream comprising dextrose and fructose from a feed stream comprising dextrose which comprises:

isomerizing a portion of the dextrose in the feed stream to produce a first dextrose/fructose stream comprising dextrose and fructose;

splitting the first dextrose/fructose stream into a first feed stream and a second feed stream;

fractionating the first feed stream to produce a high fructose stream;

crystallizing fructose in the high fructose stream to produce a mixture comprising crystalline fructose and mother liquor;

separating crystalline fructose from the mother liquor; and, blending at least a portion of the mother liquor with the second feed stream to produce a second dextrose/fructose stream which has a higher fructose-to-dextrose ratio than the first dextrose/fructose stream. (As used hereinafter, including the claims, the term "dextrose/fructose stream" shall mean a stream comprised of dextrose and fructose".)

In a related aspect, this invention relates to a process for producing crystalline fructose and a liquid-phase sweetener comprising fructose which comprises:

crystallizing fructose in an aqueous solution of fructose to produce a mixture comprising crystalline fructose and mother liquor;

separating crystalline fructose from the mother liquor; and, inhibiting further crystallization in the mother liquor to produce a liquid-phase sweetener comprising fructose.

The mother liquor remaining after crystallization is a saturated solution of fructose. The prior art, e.g., U.S. Pat. No. 3,928,062, teaches that the mother liquor can be used repeatedly for the crystallization of further crops of crystals. To produce further crops of crystals, the saturated mother liquor must be heated and concentrated to obtain a suitable supersaturated solution of fructose and thus enable crystallization in the mother liquor. It has been found that rather than enabling the crystallization of further crops, one should inhibit further crystallization so that the mother liquor can be used to produce a liquid-phase sweetener. As noted above, the mother liquor is a saturated solution of fructose. To prevent precipitation of fructose crystals therefrom during handling, transport, and/or storage, steps must be taken to inhibit crystallization of fructose in the mother liquor. This aspect of the invention is related to the first aspect of this invention discussed above, in that further crystallization is avoided. However, this aspect does not necessarily require the sacrifice of fractionation gains because inhibiting further crystallization does not necessarily require addition of dextrose, i.e., simple dilution of the mother liquor with water will serve to inhibit crystallization without diluting the fructose purity of the mother liquor on a dry solids basis.

B. Multiple High Fructose Sweetener Fractionation

In a related aspect, this invention relates to a process for producing multiple fructose sweeteners, at least one of said sweeteners comprising dextrose and fructose, which process comprises:

fractionating a feed stream comprising dextrose and fructose into a dextrose-en rich ed raffinate, a lower-fructose extract, and a higher-fructose extract, said higher-fructose extract being greater than about 90% (dsb) fructose; and, mixing the lower-fructose extract with a dextrose composition having a greater concentration (dsb) of dextrose than said lower-fructose extract to produce a liquid-phase sweetener.

"Fructose sweeteners" in this context includes any sweetener containing fructose without regard to whether the fructose is in solution, dispersed, amorphous or crystalline. For example, the higher-fructose extract can be used to produce a syrup containing fructose, crystalline fructose, or a semi-crystalline fructose wherein at least a portion of the fructose is in an amorphous solid phase.

The fractionation of an isomerized dextrose syrup, i.e., one containing both fructose and dextrose, to produce a fructose sweetener is commonly conducted by taking a dextrose raffinate and a fructose extract, with recycle of the remaining fractionation output. For example, U.S. Pat. No. 4,395,292 states that such an operating condition is preferred. However, by taking two extracts, one having a higher concentration (dsb) of fructose (i.e., a higher-fructose extract) and one having a lower concentration (dsb) of fructose, a fructose extract having a higher concentration than a single extract can be obtained without increasing the aggregate degree of resolution of the isomerized feed and all of the problems associated therewith (e.g., reduced fractionation capacity, greater evaporation load from increased elution water, and/or deleterious pressure drop due to higher elution water flow rates needed to increase resolution).

The utility of the lower-fructose extract is of a narrower scope than the utility of the higher-fructose extract (i.e., it would be difficult to use the lower fructose extract to produce crystalline fructose), but the fructose therein can be used to upgrade the fructose content of corn syrups containing even less fructose, e.g., by admixture with an isomerized corn syrup (e.g., fructose corn syrup) to produce a higher-fructose corn syrup (e.g., a 55% fructose corn syrup).

In a particularly preferred embodiment of this aspect, the higher-fructose extract is used to prepare a crystallizer feed for the crystallization of fructose. Accordingly, in one aspect, this invention relates to a process for producing crystalline fructose and a liquid-phase sweetener comprising dextrose and fructose which comprises:

fractionating a stream comprising dextrose and fructose into a dextrose-enriched raffinate, a lower-fructose extract, and a higher-fructose extract;

crystallizing fructose from an aqueous solution derived from the higher-fructose extract; and, mixing the lower-fructose extract with a dextrose composition having a dextrose concentration (dsb) greater than the lower-fructose extract to produce a liquid-phase sweetener comprising dextrose and fructose.

This embodiment is particularly advantageous because the fructose concentration (dsb) commonly required to feasibly crystallize fructose from an aqueous solution is so high that fractionation of a dextrose/fructose feed stream from an isomerization process to produce a single extract may be impractical. In other words, the degree of resolution needed to produce a single extract having a sufficiently high fructose purity to be useful as a crystallizer feed will often so reduce the fractionation capacity and/or increase other difficulties associated with fractionation that such resolution is impractical.

A possible drawback of taking both higher-fructose and lower-fructose extracts and separately using them to produce a crystalline sweetener and a liquid-phase sweetener, respectively, is that the amount of fructose in the lower-fructose extract that is available for upgrading the fructose content of an isomerized corn syrup is less than that available in a single fructose extract taken with the same aggregate degree of resolution. Thus, the total amount of fructose (dsb) available as a liquid-phase sweetener is reduced. This drawback is ameliorated by the availability of the mother liquor from the crystallization of part of the fructose of higher-fructose extract. In other words, in an especially preferred embodiment, mother liquor containing fructose, a lower-fructose extract and an isomerized corn syrup are mixed to prepare a liquid-phase sweetener (e.g., a 55% fructose corn syrup).

II. VARIABLE SUPERSATURATION COOLING CURVE

In another aspect, this invention relates to a process for producing crystalline fructose from a solution comprised of fructose comprising:

cooling said solution through an initial temperature range at an initial rate of cooling;

then cooling said solution through an intermediate temperature range at an intermediate rate that is slower than the initial rate; and, then cooling said solution through a final temperature range at a final rate that is faster than the intermediate rate.

FIG. 5 shows typical cooling curves used in crystallization processes. Curve A is a natural cooling curve and curve B is a controlled curve designed to achieve a constant level of supersaturation. FIG. 4 shows a variable saturation cooling curve of this invention. A comparison of the two figures shows the stark differences between the conventional curves and the curve of this invention.

The use of a cooling rate in an intermediate cooling period that is slower than the rates of cooling in the initial and final rates allows one to minimize both spontaneous nucleation in the solution and heat-induced degradation of the fructose in the solution, especially during the initial cooling period. The reduction in nucleation results in a crystalline product having a more nearly uniform particle size distribution and the reduction in heat damage increases the yield of fructose crystals and mother liquor and reduces the level of degradation product impurities in the mother liquor, thus improving its utility as a source of fructose for a liquid-phase sweetener.

III. PURIFICATION OF HIGH-FRUCTOSE SYRUPS BY CARBON-TREATMENT AT LOW SOLIDS

In another aspect, this invention relates to a process for preparing a concentrated solution of fructose comprising:

obtaining a solution of fructose having a fructose concentration of greater than about 75% (dsb) by weight and a dry solids concentration of less than 40%;

contacting said solution with activated carbon to prepare a purified solution of fructose; and, evaporating said purified solution to a dry solids concentration of greater than 40%.

While the treatment of sugar syrups with activated carbon to purify said syrups is generally known, it has been found that fructose syrups having a high concentration (dsb) of fructose should have a relatively low solids concentration when in the presence of activated carbon to reduce the formation of by-products (e.g., difructose) which can reduce the availability of fructose in the syrup, inhibit crystallization of fructose from the syrup, and/or affect the organoleptic properties of the syrup or a sweetener prepared therefrom. Tables II and III show the effect of solids concentration on difructose formation in a high fructose (95+% dsb) syrup over time in contact with activated carbon.

In a related aspect, this invention also relates to a process for producing crystalline fructose comprising:

fractionating a stream comprised of dextrose and fructose to produce a high-fructose stream having greater than 90% (dsb) fructose;

contacting said high-fructose stream with activated carbon to produce a purified fructose stream;

then evaporating said purified fructose stream to produce a solution of fructose; and crystallizing fructose in said aqueous solution of fructose.

The sequence of contacting and then evaporating the high-fructose stream ensures that the contacting is performed at comparatively low solids because high-fructose extracts are typically at low solids upon elution from a fractionation column.

In another related aspect, this invention relates to a process for producing crystalline fructose comprising:

crystallizing fructose in a solution of fructose to produce a mixture comprising crystalline fructose and mother liquor comprised of fructose;

separating crystalline fructose from the mother liquor;

mixing at least a portion of the fructose of said mother liquor with a liquid comprised of water to form a lower solids solution of fructose (e.g. less than about 70% dry solids);

contacting said lower solids solution of fructose with activated carbon; and, evaporating said lower solids solution of fructose to form a higher solids solution of fructose.

In particularly preferred embodiments, the mother liquor resulting from the crystallization of fructose will be mixed with a liquid comprised of water e.g., tap water, sweet water, saccharide syrups such as 42% fructose corn syrups, and the like) to reduce the solids content prior to treatment with activated carbon and then evaporation to higher solids. The resulting higher solids solution can be used in a variety of ways, e.g., as a crystallizer feed, a high fructose corn syrup sweetener or production stream therefor, all of which benefit from the advantages discussed above which result from reducing the solids concentration of the mother liquor before treatment with activated carbon and subsequent evaporation.

DETAILED DESCRIPTION

An important feature of the present invention is the synergy which obtains when anhydrous crystalline fructose (ACF) is produced in conjunction with EFCS. The yield of fructose crystals from a fructose massecuite is typically on the order of 40–55%, e.g. 45%. Longer crystallization times may increase the yield, but only at the expense of process throughput. Thus, a significant advantage is had by integrating fructose crystallization with a process which not only provides the fructose feed for the ACF crystallization process but also can accept without penalty the non-crystallized fructose from the ACF process.

In some crystalline fructose processes of the prior art, the noncrystallized portion is recycled through the crystallization process. The problem with this approach is that undesirable by-products such as difructose, 5-(hydroxymethyl)-2-furfural (HMF) and higher saccharities tend to build up in the recycle stream since crystallization is essentially selective for fructose. As a result, the recycle stream eventually becomes so contaminated with by-products that it must be purged from the system with the concomitant loss of a substantial quantity of fructose.

The present invention solves the problem of by-product built up by incorporating the solution phase material which remains after the crystallization of fructose (the mother liquor) into a process which produces high-fructose, liquid-phase sweetener(s). In this fashion unwanted by-products are not concentrated in that portion of the integrated process which produces ACF, but rather are continuously removed from that system. This integration obviates the need for fructose-containing purge streams thereby conserving fructose in more economically valued products.

Figure 1:
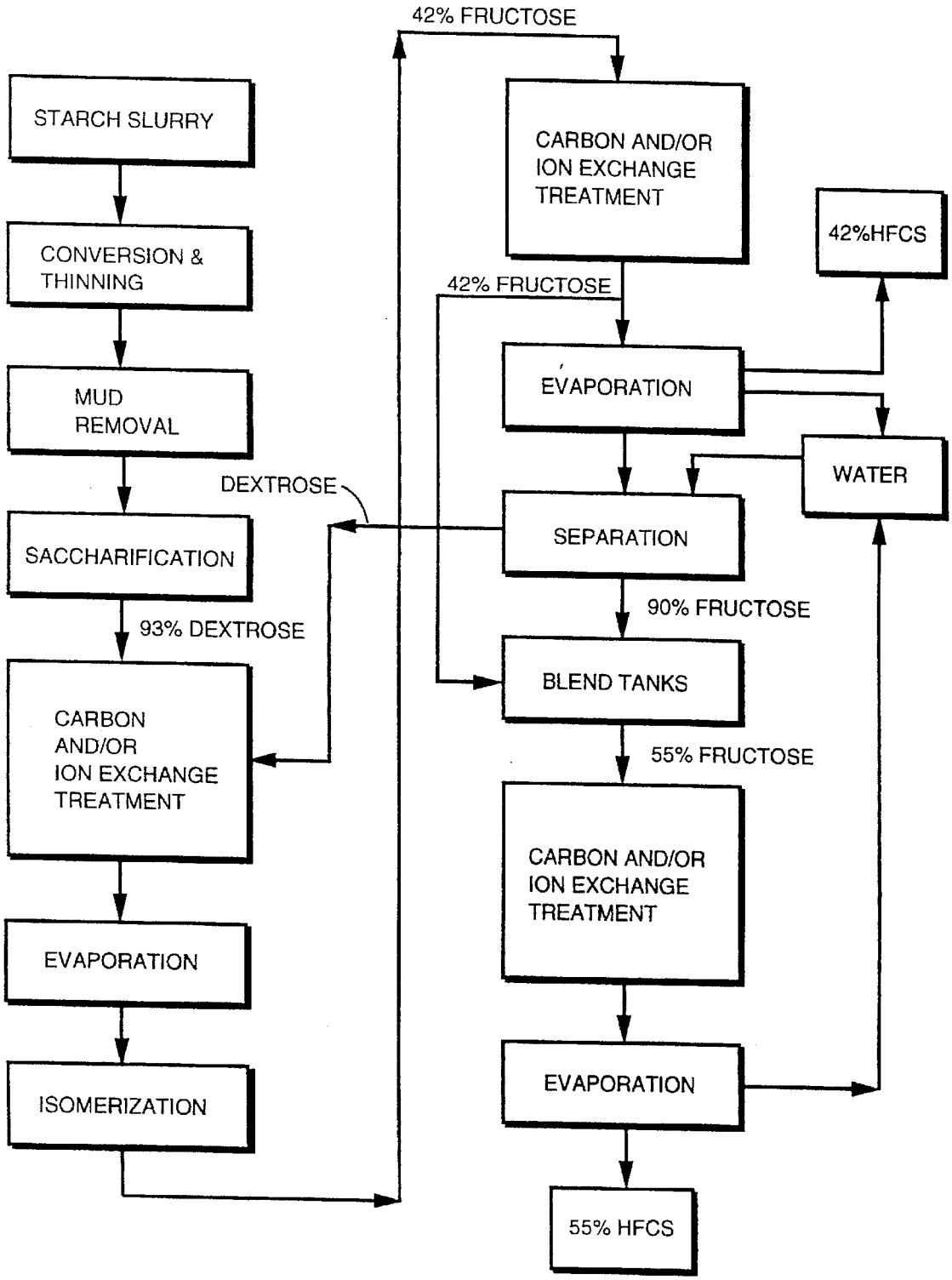
FIG. 1 shows the various steps in a conventional process for the production of 42% HFCS and 55% HFCS (EFCS) from starch.

Referring to FIG. 1, it can be seen that the production of 55% HFCS (EFCS) requires a separation (fractionation) step in the process stream. In general, fractionation is required to make syrups having a fructose content higher than approximately 48%. For the purpose of crystallizing fructose, a syrup containing more than 95% fructose (dsb) is preferred. Although it is possible to crystallize fructose from solutions containing less fructose than this, lower yields will be obtained and the process would not be as economically desirable.

Fractionation techniques are known which will provide a 95+% fructose stream from a feed comprising about 42% (dsb) fructose (the typical output from dextrose isomerization). Thus, it is possible to obtain an ACF feed stream from an EFCS process with little or no modification. Most preferably, the fractionation system is of the simulated moving bed chromatographic type, as is well-known in the art.

Figure 2:
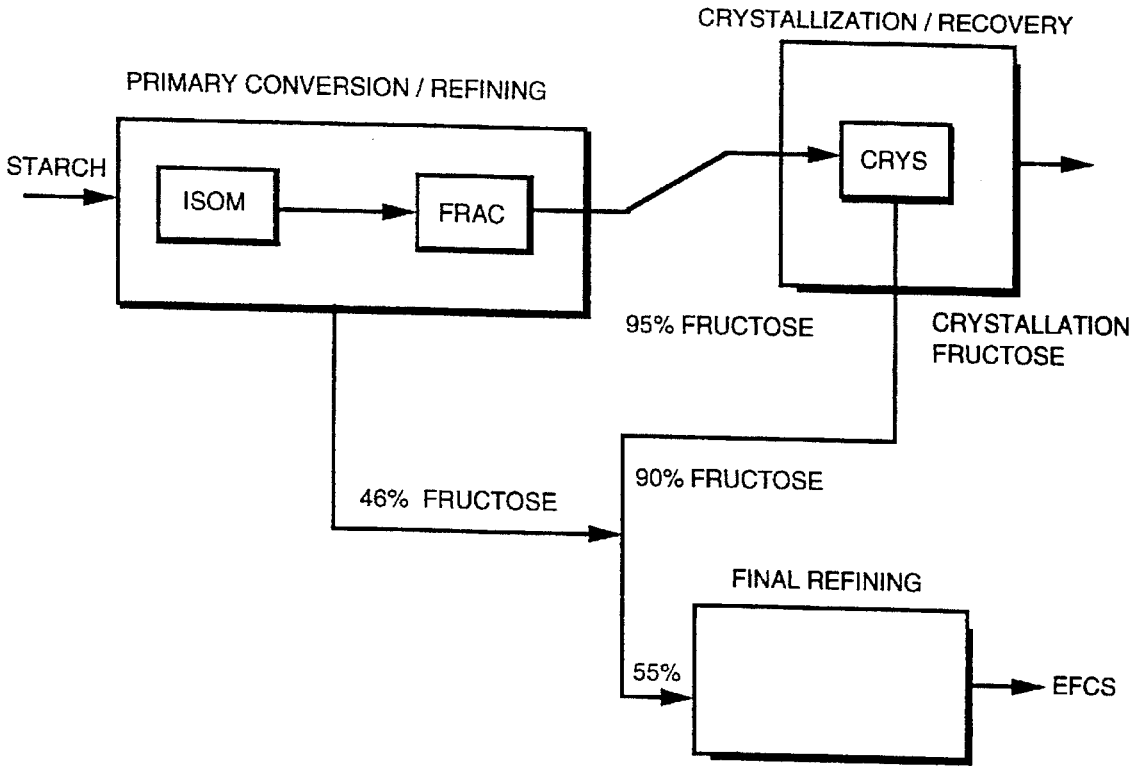
FIG. 2 shows an integrated, starch-based process for producing both crystalline fructose and EFCS.

Referring now to FIG. 2, the details of the integrated process will be described. As shown in the block labeled "Primary Conversion/Refining," starch is first converted to dextrose using the conventional enzyme-based process described hereinabove.

Isomerization

The isomerization step employs an enzyme to convert dextrose to fructose. The enzyme is fixed to a carrier and is stationary in a column (isocolumn) until it is replaced when it is exhausted. One advantage of the present invention is that it permits the efficient utilization of increased quantities of isomerase in the isocolumns, Owing to seasonal fluctuations in the demand for EFCS (55% fructose), a producer who invests in additional isomerase to meet peak demand must pay for that increased level of isomerization capacity throughout the year even when his EFCS production is at a relatively low level. By selectively practicing the integrated process disclosed herein, a producer can efficiently utilize the increased level of isomerization by channeling more of the high-fructose stream from the fractionation train to EFCS production when demand for that product is high and employing a greater portion of that stream in ACF production when demand for EFCS is lower. In this way an investment in increased isomerization capability can be effectively utilized throughout the year.

Fractionation

Figure 3:
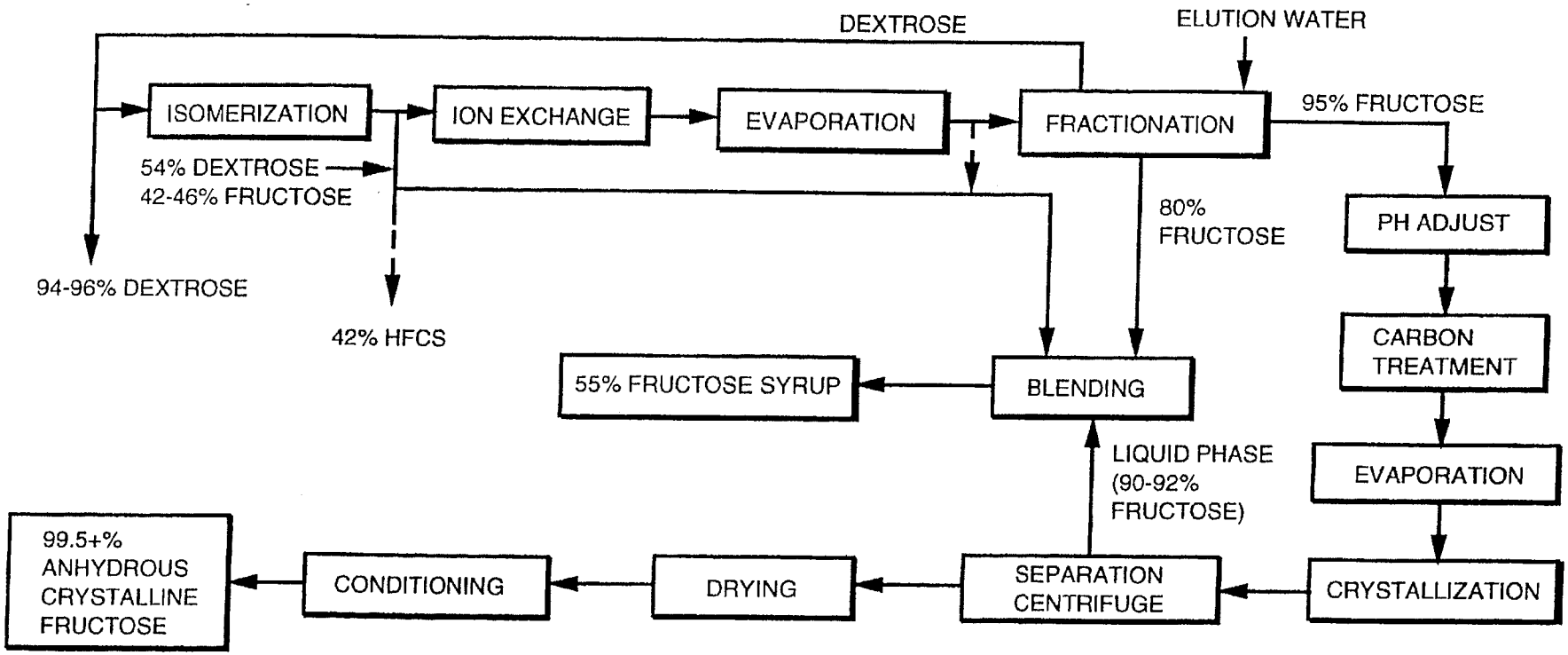
FIG. 3 shows in more detail the process illustrated in FIG. 2.
Figure 4:
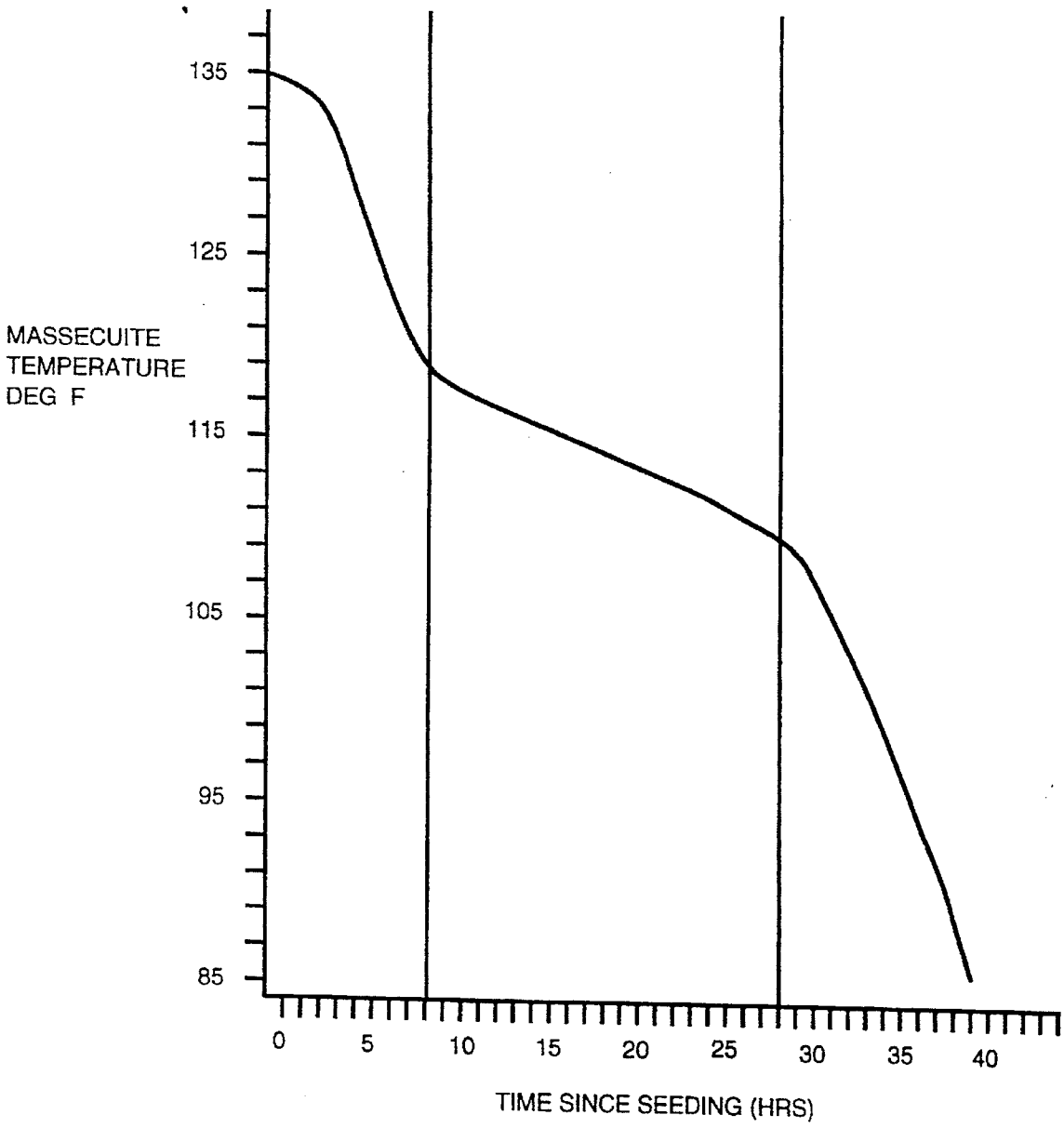
FIG. 4 is a graph of massecuite temperature versus time since seeding for a typical variable supersaturation cooling program of the invention.
Figure 5:
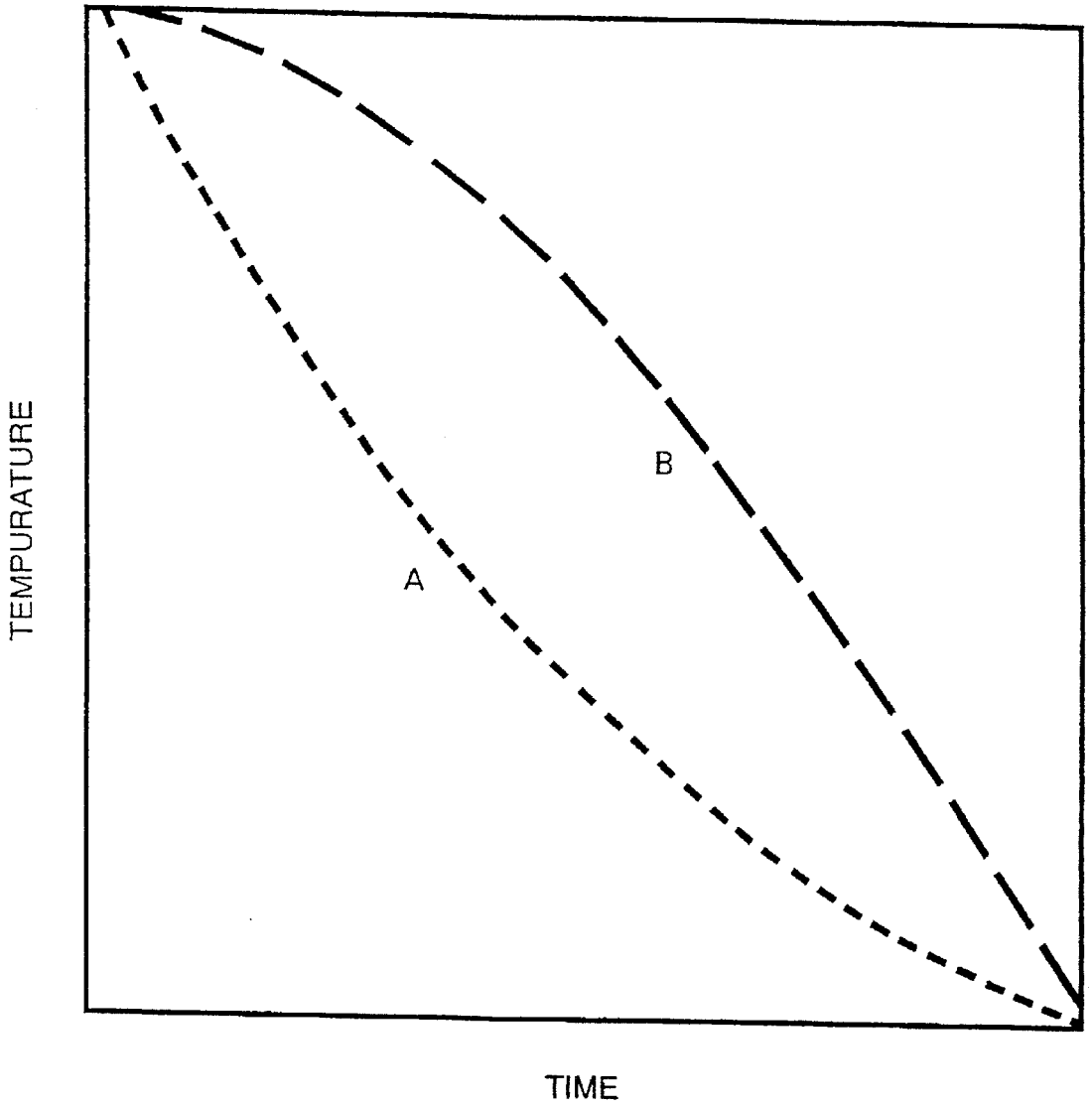
FIG. 5 is a graph of temperature versus time in a batch crystallizer for both the natural cooling curve (Curve A) and a constant supersaturation cooling curve (Curve B).

Fractionation occurs in a train, or group of vessels containing resin which operate in sequence to separate fructose from dextrose in the syrup feed stream. The feed stream and elution water stream are fed into the train and one or more high-fructose product streams, a high-dextrose raffinate stream, and/or one or more high-oligosaccharide raffinate streams are removed. As shown in FIG. 3, the high-dextrose stream is recycled to isomerization for conversion to fructose while the high-fructose stream(s) goes into the ACF portion of the process or is blended to make EFCS.

Fractionation capacity is measured by the feed flow rate, percent fructose in the product stream, and recovery of fructose in the stream. For a given dsb, fructose content, the higher the fractionation capacity, the lower the fructose conversion that is needed in isomerization. Therefore, to lower the isomerase ingredient cost, fractionation is preferably continuously operated at its maximum capacity.

To obtain practical crystallizer yields from the ACF process the fractionation product must be greater than about 90% (dsb) fructose and preferably greater than 95% (dsb) fructose. Since this is higher than the 90% (dsb) fructose normally isolated in an EFCS process, special operating conditions for conventional fractionation systems have to be used that may result in decreased fractionation capacity. These are: 1) slowing the syrup feed rate without changing the elution water ratio to enhance resolution and/or, 2) increasing the elution water ratio to enhance resolution. These operating conditions have the disadvantage of either decreasing product throughput and/or adding water which must subsequently be removed, entailing at least the expenditure of additional energy. There is, however, a preferred alternative.

As will be appreciated by those skilled in this art, when an aqueous solution comprising dextrose and fructose is passed through a suitable chromatographic column, at least a partial resolution of the two species is obtained. To achieve fractionation, the effluent from the column must be diverted as appropriate in order to isolate the desired fractions. The diverted portions are commonly referred to as "cuts". A "narrow cut" contains fewer volume elements of the effluent than does a "wide cut". Thus, in terms of purity, a separation may be optimized for a particular species by taking an appropriately narrow cut. The usual trade-off for taking a narrow cut from the effluent is that the total recovery of the selected species is adversley affected.

It has been found that the 95+% (dsb) fructose stream which is preferred as the feed for the crystalline fructose portion of the disclosed process may be obtained by taking an appropriately narrow cut from the product stream of the fractionation system of a conventional process for the production EFCS. One such fractionation system which is particularly preferred is described in the commonly-owned U.S. patent application of John F. Rasche, Ser. No. 861,026, filed 5/8/86 which is entitled "Simulated Moving Bed Chromatographic Separation Apparatus." The teachings of this disclosure are expressly incorporated herein.

A preferred way of operating the above-referenced chromatographic separation apparatus when employed in the fractionation system of the present invention is to increase the eluant-to-feed ratio from about 1.7 to about 2.0. The syrup feed is preferably about 60% dry substance by weight and is maintained at a temperature of about 140° F.

The raffinate stream from the fractionation system may be apportioned in a manner similar to that used to divide the extract stream. In this way a stream relatively rich in oligosaccharides may be isolated for recycle to the saccharification system, sent to a separate, dedicated saccharification system, or purged from the system.

In the absence of a purge or recycle of oligosaccharides to a saccharifiction system, the only outlet for oligosaccharides from the system is the extract stream inasmuch as the typical isomerization has no effect on oligosaccharides. Thus, oligosaccharides in the raffinate stream which are recycled to the isomerization system simply pass through that system unchanged and return in the feed to the fractionation system.

Oligosaccharides are undesirable in the extract stream since at least a portion of that stream is used as feed to the fructose crystallization portion of the process and the crystallization of fructose is preferably accomplished from a solution containing a minimum of other species. Likewise, oligosaccharides are undesirable in the liquid-phase sweetener produced by the process of the present invention, hence only a limited quantity of such oligosaccharides can be removed from the system via the liquid-phase product.

An additional advantage is had by recycling an oligosaccharide-rich stream from the fractionation system to the saccharification system. Such a stream will typically be relatively low in dry substance content, most commonly about 10% d.s.—i.e., it is about 90% water by weight. The starch slurry resulting from the liquefaction/dextrinization portion of the process must typically be diluted prior to saccharification. The water in the oligosaccharide stream can substitute for at least a portion of the water used as a diluent for the starch slurry thereby conserving water and decreasing the evaporation capacity required for the system as a whole.

Blending

In a conventional EFCS process, the high-fructose extract from fractionation is blended with the product of isomerization (typically 42–48% (dsb) fructose) to obtain the desired fructose content in the final product (55% (dsb) for EFCS). In the integrated process of the present invention, mother liquor from the centrifugation step of the crystallization process containing about 88–92% (dsb) fructose, preferably 90–92% (dsb) fructose, at approximately 83% d.s. is additionally available for blending. This gives additional flexibility to the process since various streams can be blended for input to EFCS polishing steps where the blend is typically ion exchanged, carbon treated, and then evaporated to 77% d.s. as part of conventional EFCS production. The dashed lines in FIG. 3 indicate some of the options for blending. The ultimate choice of blend streams depends, of course, on mass balance of the system as a whole.

Since no chemicals are added to the high-fructose stream in the ACF process other than the very small quantities of hydrochloric acid or soda ash for pH adjustment, significant quantities of new trace components are not generated in the ACF process. Color bodies, HMF, and difructose may be generated during the carbon treatment and evaporation steps of the crystallizer feed treatment. However, these compounds can be removed by finish carbon and ion exchange treatments in the EFCS process.

Inasmuch as most steps of the entire fructose process can be operated at high dry substance levels, microbial growth is inhibited and should not be of major concern. As a result, the acetaldehyde level should not increase significantly and can be reduced by the finish ion exchange and final evaporation steps if necessary.

FRUCTOSE FEED TO CRYSTALLIZER pH Adjustment

It has been found that the pH of the aqueous fructose solution from which fructose crystals are to be obtained is preferably between about pH 3.7 and about pH 4.3, teachings to the contrary (see, e.g., U.S. Pat. No. 3,883,365) notwithstanding. Proper control of the pH of the fructose feed to the crystallizer is necessary to minimize the formation of difructose anhydrides. The presence of difructose anhydrides in the crystallizer has been found to result in lower crystallizer yields and adversely affects the size distribution of the fructose crystals that are formed. It is believed that the rate of formation of anhydrides is at a minimum in the pH range 3.7 to 4.3. Higher anhydride formation rates obtain both above and below this range. It is further believed that the formation of color formers is favored at higher pH levels.

EXAMPLE

The effect of pH on the solubility of fructose and the generation of impurities in a syrup containing approximately 95% fructose on a dry solids basis were investigated as described below. The syrups studied are representative of those used as feed for the fructose crystallization portion of the disclosed process.

Crystalline fructose was added to a sample of VEFCS (90% fructose, dsb) to produce a syrup comprising approximately 95% (dsb) fructose. The syrup was subsequently subjected to treatment with granular activated carbon as described in the section of this disclosure entitled "Carbon Treatment". Thus, this syrup was treated in the same way as feed to the crystallizer.

An aliquot of the above-described syrup was adjusted to pH 3.94 and evaporated at 73° C. to high solids. Two liters of this high-solids syrup were placed in a sealed, stirred flask and immersed in a constant temperature bath maintained at approximately 55° C. This sample ("the pH 4 sample") was stirred continuously in the constant temperature bath while a second sample was prepared (approximately 5 hours).

A second aliquot of the 95% fructose syrup was adjusted to pH 5.48 and evaporated at 77° C. to high solids. This evaporation was accomplished more slowly than that of the pH 4 sample. Two liters of this sample ("the pH 5.5 sample") were placed in a sealed, stirred flask and immersed in the constant temperature bath containing the pH 4 sample.

After adjusting the temperature of the bath to 55.5° C., 50 grams of fructose seed crystals were added to both samples. Stirring was continued for 60 hours at constant temperature. This is the approximate crystallizer residence time of the syrup in the ACF process disclosed herein.

The resulting massecuites were sampled, centrifuged, and the mother liquor analyzed along with samples of the feed syrup. The resulting analytical data are tabulated below.

TABLE I

| | FEED | | EQUILIBRATED | |
|---|---|---|---|---|
| | pH 4 | pH 5.5 | pH 4 | pH 5.5 |
| Fructose (% dsb) | 95.81 | 95.86 | 95.33 | 95.24 |
| Fructose (% dsb) following hydrolysis | 96.08 | 96.10 | 95.33 | 95.72 |
| Mono-anhydrides (% dsb) | 0.27 | 0.24 | nd* | 0.48 |
| Solids (weight %) | 89.79 | 89.13 | 88.90 | 88.86 |
| HMF (ppm dsb) | 5.71 | 4.03 | 25.9 | 6.58 |
| Acetaldehyde (ppb total) | 104 | 48 | 58 | 66 |
| Furfural (ppm dsb) | nd* | nd* | 0.29 | 0.44 |
| Color (RBU units) | 14.0 | 39.6 | 50.7 | 163.1 |
| Solubility (g fructose/g water) | — | — | 7.64 | 7.60 |
| Supersaturation | — | — | 1.0 | 1.0 |

*nd: none detected

Mono-anhydrides are calculated from the difference in the fructose assay before and after hydrolysis of the sample. Fructose solubility is calculated from the fructose assay (before hydrolysis) and the solids content of the sample. Some fructose crystallized out of both sample solutions to establish equilibrium.

The color increase in the pH 5.5 sample was significantly greater than that observed in the pH 4 sample. Higher color would result in lower yields for the crystallization process inasmuch as more washing of the centrifuge cake would be required. Mother liquor refinement requirements would also likely be increased.

Both samples exhibited similar increases in mono-anhydrides during preparation of feed (compare 0.27% dsb at pH 4 with 0.24% dsb at pH 5.5); however, the results of liquid chromatographic studies (not shown above) indicated that more difructose dianhydrides may have been formed at pH 5.5.

In summary, the pH 4 sample exhibited less color formation, exhibited a decrease in total acetaldehyde content, and had a solubility not significantly different from the pH 5.5 sample. A pH 4 feed syrup for an ACF process therefore has advantages over a pH 5.5 feed with regard to product yield and mother liquor quality as a result of its lower color content. Lower pH apparently minimizes color and difructose formation and has negligible effect on solubility.

As shown in FIG. 3, pH adjustment is conveniently accomplished subsequent to fractionation and prior to carbon treatment. The viscosity of the fructose solution is relatively low at this point in the process and thus is is relatively easy to obtain thorough mixing of the solution with the acid or base used for pH adjustment. A number of acids and bases suitable for this purpose are known in the art. Especially preferred are hydrochloric acid (HCl) to lower pH and anhydrous sodium carbonate ($Na_2CO_3$, "soda ash") to raise pH. Carbon Treatment The 95+% (dsb) fructose feed stream for the crystallization process is preferably carbon-treated prior to concentration by evaporation. One purpose of carbon treatment is to remove impurities that may inhibit crystallization. Another purpose is to remove impurities such as color bodies, HMF, furfural, and acetaldehyde which adversely affect the quality of the mother liquor and consequently impair its use as a component of a liquid-phase sweetener. Carbon treatment is preferably accomplished with granular carbon, at a dosage of about 1–3% dry substance, or powdered carbon, typically at a lower dosage than granular carbon. The temperature of the syrup is preferably about 160° F. and (typically 15–30) the syrup is * preferably about 20 to about 25, percent by weight dry substance.

Carbon treatment is most advantageously performed immediately following fractionation and before evaporation. Carbon treating at low solids concentration has been found to keep fructose loss to difructose below 0.5%. If carbon treatment is accomplished after evaporation, fructose losses greater than 2.5% can be expected. The syrup temperature should be approximately 160° F. (as compared to 140° F.) to prevent microbial growth in the carbon adsorber and also to lower the syrup viscosity to obtain better diffusion into the carbon particles.

EXAMPLE

The amount of difructose formed in aqueous solutions of at least 95% (dsb) fructose at varying dry solids was measured. In the first two trials, the aqueous solutions were mixed in a flask with 2.7% granular carbon (dry solids of granular carbon by weight of the dry solids of the aqueous solutions) and agitated at 160° F. for 24 hours. Samples were taken at 0, 6, 14 and 24 hours for measurement of the difructose contained therein. The results are shown below:

TABLE II

| | | Difructose (% dsb) at: | |
|---|---|---|---|
| Time (hrs) | Dry Solids: | 25% ds | 50% ds |
| 0 | | 0.25 | 0.47 |
| 6 | 0.32 | 0.85 | |
| 14 | 0.38 | 1.62 | |
| 24 | 0.78 | 1.94 | |

The above data shows that difructose formed much faster (up to 4 times faster) in the solution at ds as compared with 25% ds.

The following four trials were designed to simulate the operation of a commercial scale carbon-treating tower in a plug flow manner; i.e., to allow measurement of difructose formation in a dynamic flow system as compared with the static system of an agitated flask.

Two 12-inch glass columns were run in series to provide a residence time for the syrup feed of about 20 hours. The columns and a short coil of stainless tubing used for feed preheat were immersed in regulated water baths.

To simulate a counter-current flow of carbon at steady state, the columns were initially run to condition and partially exhaust the carbon and the second column was then slugged with virgin granular activated carbon, placing about two inches of fresh carbon at the outlet of this column.

Four different conditions were examined using this apparatus: (with conditioned, new granular carbon for each condition)

70% ds at 140° F.

70% ds at 160° F.

50% ds at 160° F

25% ds at 160° F.

Each of the conditions listed was run with continuous feed and no recycle for 36 hours and the amounts of difructose in the column effluent at 0, 6, 14, 24 and 36 hours are shown below:

TABLE III

| Temp: | Difructose (% dsb) at: | | | |
|---|---|---|---|---|
| Dry Solids: | 140° F. | 160° F. | | |
| Time (hrs) | 70% ds | 25% ds | 50% ds | 70% ds |
| 0 | 0.32 | 0.32 | 0.35 | 0.32 |
| 6 | 0.83 | — | — | 1.6 |
| 14 | 0.26 | 0.92 | 0.95 | — |
| 24 | 0.39 | 0.61 | 1.35 | 1.83 |
| 36 | 0.24 | 0.64 | 1.72 | 2.24 |

While the formation of difructose at 140° F. at 70% ds appears to present no problem, the lower temperature means an increased risk of microbial growth and higher syrup viscosity. Both of the higher solids tests at 160° F. (50% and 70% ds) showed difructose levels that continued to substantially increase over time, although the time of exposure to heat and carbon was the same for all samples taken. Without wishing to be bound by any particular theory, a possible explanation may be that the formation of difructose is catalyzed and/or co-catalyzed by material being removed from the aqueous solution by the carbon and thus the buildup of this material on the carbon causes an increasing rate of conversion of fructose to difructose over the time of use of the carbon.

A carbon check filter may be used on the syrup leaving the carbon column to remove any carbon fines in the stream. Efficient filtering is important because any insoluble material that passes into the crystallizer will be centrifuged into the crystalline fructose and directly affect product quality.

Since the fructose that does not crystallize is blended to make liquid-phase sweetener, the carbon treatment enhances the quality of that material as well. Since EFCS is normally carbon-treated near the end of the process (i.e., after blending), the mother liquor from the centrifuge has been refined by two carbon treatments by the time it reaches the final product.

Crystallizer Feed Evaporator

The driving force for the crystallization is supersaturation obtained by cooling high-fructose syrup to a point below its saturation temperature. The saturation curve for fructose (concentration vs. saturation temperature) is very steep. To achieve theoretical crystallizer yields in the 40–55% range, e.g. 0–48% a fructose feed syrup requires approximately 45°–55° F., e.g. 47° F., of cooling.

During the evaporation step(s) water is removed from the feed syrup to concentrate it to the point that fructose will crystallize from the solution when it is cooled. The evaporators are preferably designed and operated to concentrate the solution with minimum heat damage to the syrup. One preferred way of effecting evaporation entails a two-step process. The feed syrup is first concentrated in a 6-pass tube-type falling film evaporator having multiple effects and mechanical recompression. The 95+% (dsb) fructose stream from the carbon treatment step is supplied to the evaporator at about 20 to about 25 percent by weight dry substance, at a temperature of about 190° F., and at a pH of about 3.7 to about 4.3. The output of this step is a syrup having about 55 to about 65 percent by weight dry substance.

In the second evaporation step, the output from the first step is fed to a plate-type, rising film, single effect evaporator operated at about 23 to about 24 in Hg vacuum. The output of the second step is a syrup at about 165° to about 175° F. having about 88 to about 90 percent by weight dry substance. More preferably, the evaporator is operated at about 26 in Hg vacuum such that the product temperature is about 140 to about 150° F., thereby minimizing the loss of fructose.

The main criterion in crystallizer feed evaporator design and operation is to concentrate the solution which minimum heat damage to the syrup. The most troublesome heat damage to crystallizer feed syrup is conversion of fructose to difructose which reduces yield in the crystallizer. The formation of difructose is favored by high temperature, high concentration, and long residence time in the evaporator. Since concentration is essentially fixed, design and operating conditions should be chosen to minimize temperature and residence time of the syrup in the evaporator.

Suitable evaporators such as the tube-type falling film and the plate-type rising film are generally known in the art.

Crystallization

Crystallization of fructose may be accomplished in either batch or continuous crystallizers. There are advantages and disadvantages to both batch and continuous crystallization. Batch crystallization has greater flexibility in producing different crystal size distributions, and can adjust for process upsets more easily and quickly. However, batch crystallization has lower crystallizer productivity (time required to load, unload, and seed the crystallizer); it is more difficult to produce a consistent crystal size distribution from batch to batch; it requires larger storage tanks for feed and for massecuite in order to keep batch cycle times to a minimum; and, it requires individual cooling systems for each crystallizer. Continuous crystallization has the opposite advantages and disadvantages.

Crystallization may be accomplished in either a single pass or multiple passes. Single pass, however, is preferred. It is estimated that only 88% of the yield per batch would be achieved and crystallization time would be 87% longer for second pass crystallization. Moreover, the mother liquor from a second pass crystallization is more viscous due to greater levels of higher saccharities and slurry density (pounds crystal per pound massecuite) is lower for second pass massecuite. Both these factors tend to reduce centrifuge productivity.

The utility of the mother liquor as blend stock for a liquid-phase sweetener depends in large part on the purity of the mother liquor. While the precise levels of by-products that can be tolerated in, or efficiently removed from, the mother liquor will depend upon a variety of factors, steps should be taken to minimize the formation of by-products in the crystallization portion of the process. Inasmuch as crystallization is essentially selective for fructose, by-products tend to become concentrated in the mother liquor with each successive crystallization pass. Thus, the problem is exacerbated in the case of multiple pass crystallizations and the level of by-products in the mother liquor will often impose an upper limit on the number of crystallization passes which may actually be employed in the integrated process.

It has been found that color, ash, HMF, furfural, and acetaldehyde levels all tend to increase in the mother liquor during multiple pass crystallization. Of these, color increases most rapidly, and it is therefore usually the determining factor in the number of crystallization passes which may effectively be employed.

Appropriate measures to maintain the purity of the mother liquor include careful control of evaporation, carbon treatment, and crystallization conditions such as pH, temperature, and residence times. Preferred conditions are discussed in the sections of this disclosure devoted to the various steps of the process.

Syrup feed to the crystallizer is preferably cooled to approximately 140° F. before entering the crystallizer. To produce a 40–48% theoretical yield of crystalline fructose it should contain a minimum of 95% (dsb) fructose and have a solids content of 88.5–89.7% by weight (nominal 89% d.s.b).

The batch is seeded and thoroughly mixed with the seed crystals. The seeding temperature (approximately 135° F.) is based on the estimated percent d.s. and percent fructose of the crystallizer batch. Once the syrup is thoroughly mixed with the seed crystals, a sample of the batch should be analyzed to determine the actual saturation temperature. The cooling system of the crystallizer should be adjusted to bring the batch into the supersaturation range 1.00–1.05 (based on fructose concentration). If the massecuite is already below this range, but nucleation has not occurred, cooling should continue.

Nucleation is a process by which crystals are formed from liquids, supersaturated solutions (gels), or saturated vapors (clouds). A crystal originates on a minute trace of a foreign substance acting as a nucleus. These are often provided by impurities. Crystals form initially in tiny regions of the parent phase and then propagate into it by accretion. In the process of the subject invention, nucleation is undesirable inasmuch as it gives rise to a produce of small crystal size. Moreover, control of the crystal size distribution is lost if appreciable nucleation occurs. For these reasons, the use of seed crystals is preferred.

The progress of the crystallization can be controlled indirectly by the rate of massecuite cooling, the setpoint for the cooling water being adjusted according to predetermined cooling curve such that the supersaturation level is 1.0 to 1.35, e.g. 1.0 to 1.3.

More preferably, supersaturation is actually measured in order to directly control the progress of the crystallization. Supersaturation can be estimated from percent d.s. of the mother liquor alone given the initial percent d.s. and percent fructose. Using the supersaturation data, a decision can be made whether to continue a batch on a predetermined cooling curve or to modify the cooling rate so as to maintain the desired degree of supersaturation.

One preferred way of effecting crystallization comprises seeding a 95+% (dsb) fructose syrup having about 88 to about 90 percent by weight dry substance, a pH of about 3.7 to about 4.3, and a temperature of about 130° to about 138° F. with about 7 to about 10% by weight of seed crystals having a mean particle size of about 150 to about 250 micrometers. The seeded syrup is then subjected to controlled cooling to cause the fructose in solution to crystallize out.

The cooling can be accomplished as follows: from a syrup temperature of about 138° to about 115° F. the syrup is cooled at a rate of about 0.5° F./hr; from about 115° to about 86° F. the syrup is cooled at the rate of about 1.0° to about 1.5° F./hr. It is recommended that the supersaturation level be maintained below about 1.17° when the syrup temperature is above about 115° F. and maintained below about 1.25 if the syrup temperature is below about 115° F. The maximum temperature difference between the coolant and the massecuite is preferably about 10° F. Too high a temperature difference may cause nucleation to occur.

Preferably, however, cooling is controlled at differing rates in at least three periods. For example, during the Initial Period, when the syrup is between about 138° and about 125° F., the cooling is accomplished at a rate between about 1.0° and about 1.5° F./hr and the supersaturation level is maintained below about 1.20. During the Critical Period, when the syrup is between about 125° and about 110° F., the cooling rate is preferably about 0.5° to about 1.0° F./hr and the supersaturation level is maintained below about 1.17. And, during the Rapid Cooldown Period, when the syrup is between about 110° and about 86° F., the cooling rate is preferably about 1.5° to about 2.5° F./hr and the supersaturation level is maintained below about 1.25.

It has been found that a preferred means of cooling involves coupling a continuous monitor of the level of supersaturation to an automatic control of the cooling water temperature. In a particularly preferred means, a data processor continuously receives information about massecuite temperature, cooling water temperature and supersaturation. The processor then uses this information to control temperature ($T_s$) to the cooling water temperature and thus, the rate of cooling of the massecuite. The data processor is programmed to first cool the massecuite from its seeding a predetermined critical temperature (T') at 2.5° F./hr. (The critical temperature is predetermined by calculating from the % fructose and % ds of the crystallizer feed the temperature at which the level of supersaturation will reach 1.17). The program then provides for cooling of the massecuite from T' to 115° F. at 1° F./hr and from 115° F. to final temperature (typically 86° F.) at 1.5° F./hr. However, the program has overrides to prevent excessive nucleation. First, the program provides that, in any event, the temperature difference between the massecuite and cooling water will not at any time during cooling exceed a predetermined temperature (typically about 14° F.). Second, the program provides that, in any event, the level of supersaturation will not at any time during cooling exceed a predetermined value (typically 1.28). The particular temperatures and rates described above may be varied to optimize the curve for a given set of crystallization conditions without undue experimentation. The major factors which affect the temperatures are the total dry solids level (% ds) and the total surface area of the seed. For example, increasing the dry solids level will move the critical period to a range earlier in the cooling curve and vice versa. Decreasing the total surface area of the seed, e.g. by decreasing the amount of seed loaded, will broaden the critical period, and vice versa.

Crystallization Kinetics Supersaturation

In crystallization kinetics, the growth rate is a function of a concentration driving force-the concentration present in the mother liquor versus the concentration that would be present at that temperature at equilibrium.

Supersaturation is a measure of the concentration driving force. There are many ways of defining supersaturation. For fructose crystallization, it has been found that supersaturation defined on a water basis is the most reliable for the purpose of monitoring the progress of the batch. Thus, supersaturation is defined as the ratio of the grams of fructose per gram of water in the supersaturated syrup to that which obtains at equilibrium:

$$\text{Supersaturation} = \frac{(\text{Fructose/Water})_{ACTUAL}}{(\text{Fructose/Water})_{EQUIL}}$$

Ideally, the batch cooling rate should be adjusted to control the supersaturation level of the mother liquor. For the crystallization of fructose it has been found that the supersaturation range 1.0–1.30 produces an acceptable yield of crystals in the desired size range. Supersaturation levels below this range result in extended batch cooling times while supersaturation levels in excess of 1.35 result in severe nucleation.

Nucleation

There is a tradeoff in selecting a target value of supersaturation. Fructose does not appear to have a detectable metastable zone, i.e., a range of supersaturation wherein no nucleation occurs. The growth of existing crystals is always competing with the birth of new crystals (nucleation). As the supersaturation level is raised, the crystal growth rate increases, but so does the nucleation rate. The goal is to find a supersaturation level that will produce the desired crystal size in an economically advantageous cycle time.

The nucleation referred to above is the "shower" or "shock" type, As mentioned above, fructose crystallization is always accompanied by nucleation. Shock nucleation can occur at the start of the batch upon occur at the start of the batch upon seeding. It is contemplated that this is due to a low seeding temperature. If nucleation occurs, the massecuite should preferably be heated to remove the nuclei. Once the nuclei have been dissolved, cooling can begin.

A preferred method of avoiding shock nucleation is to maintain the supersaturation level below 1.30 after seeding. Massive nucleation will greatly increase the viscosity of the massecuite, making centrifuging very difficult by greatly increasing the purge time. Fine crystals separated from the massecuite are much more difficult to dry and tend to agglomerate more easily. Massive nucleation gives rise to a product with undesirably small mean crystal size.

It has been observed that a 95-gallon batch of syrup in a 100-gallon crystallizer will require about a 30- to 80-hour cooling cycle and usually about 35- to 40-hour cooling cycle for fructose crystallization. During that period the syrup is preferably cooled at multiple, preferable three, different rates. The requirement of different cooling rates is a consequence of the nonlinearity of fructose crystallization. The various rates correspond to the different periods of growth found during cooling.

Initial cooling covers the temperature range down to about 120° F. The target cooling range is about 1° to 4° F./hr; the typical rate is 2° F. per hour, which makes this period require four to six hours, preferably about eight hours. During this time growth occurs almost entirely on the seed crystals and slurry density builds slowly. Most of the heat load on the cooling water comes from removal of sensible heat.

Nucleation of the batch can occur in this region; however, this will occur only if the seeding temperature is too low or supersaturation exceeds 1.3.

In the "Critical Period" the growth rate increases by a factor of 2 to 4. Slurry density increases rapidly and new crystals are born and grow into the desired size range. The competing processes of crystal growth and nucleation both accelerate.

The boundaries of this region are not clearly defined. Best estimates place it between 120° and 110° F. Caution is required in this region inasmuch as nucleation processes can easily dominate and get out of control. By maintaining a moderate level of supersaturation (1.05–1.20), it has been found that nucleation can be kept within acceptable limits. A slower cooling rate is the preferred way to control the degree of supersaturation. In this region a cooling rate of about 0.5° to 3.0° F./hr, typically a 0.5° to 1.5° F./hr cooling rate, is recommended. At this rate the estimated time in the Critical Period is about 10–40 hours, preferably about 18–22 hours.

In some situations, high supersaturation levels may not result in nucleation. In that case, further cooling could lead to the formation of fructose hemihdyrate. This species occurs in the form of needle-shaped crystals which form a slurry having a very high viscosity (>800,000 cps). This slurry is impractical to centrifuge and may even overload the crystallizer drive. The hemihydrate can be detected during routine crystal inspections which should be conducted throughout the cooldown period.

Upon completing the Critical Period the slurry density is high enough to support a faster cooling rate without nucleating. In this rapid cooldown region the cooling water temperature can be dropped rapidly. Massecuite cooling rates of from about 1° to 7° F./hr, preferably about 1°–4° F./hr, are recommended. To cool from 110° to a final temperature of about 100°–75° F. will require about 3–12, typically 8–12, hours. More rapid cooling can be done without nucleation, but the growth does not keep pace and one may be left with a higher level of supersaturation at the end of the batch. Some residual supersaturation can be relieved by placing the massecuite in a mingler or a mixer tank for a period of time.

While cooling can be accomplished more rapidly in the Rapid Cooldown Period than in the earlier phases of the batch, there is a limit to how great a temperature difference can be tolerated between the cooling water and the massecuite. This limit is not known with precision, but cooling rates should not produce temperature differences between the massecuite and the cooling surfaces greater than about 15° F. Temperature differences greater than this may cause nucleation and fouling of cooling surfaces.

Seeding

The seeding temperature may be derived from the saturation temperature of the full crystallizer mother liquor. To obtain this information, a liquid chromatogram of the feed syrup and the refractive index can be taken. The percent fructose and the percent d.s. of the feed syrup are then used to calculate a fructose concentration. Seeding should be accomplished in the supersaturation range of greater than 0.96, e.g. 1.0 to 1.10.

Most preferably the seed is dried crystalline fructose having a mean crystal size of about 100–400 microns. A 1 to 20% (dsb) loading is recommended. The loading depends upon the particle size desired in the final product. Seed should be added to the full crystallizer with every effort made to distribute the seed uniformly in the crystallizer. As mentioned above, U.S. Pat. No. 4,164,429 describes a process and apparatus for producing crystallization seeds.

Seeding is preferably accomplished by first mixing the seed crystals with fructose feed syrup to obtain a liquid slurry for addition to the crystallizer. This has the effect of conditioning the surfaces of the seed crystals. Preparing the seed crystals in syrup also minimizes the formation of bubbles in the crystallizer upon seeding. Bubbles are a possible site of nucleation.

Consistent seeding is largely a matter of providing the same surface area for growth of fructose crystals. Since the surface-area-to-volume ratio of seed crystals generally decreases with increasing particle size, if the size of the seed crystals is increased, a grater weight of seed crystals is required to obtain the desired surface area.

Alternatively, a heel of about 5 to 30%, preferably about 10 to 20%, may be left in the crystallizer to act as seed. This procedure is much less labor intensive than using dry seed, but produces a broader distribution of crystal sizes since fine particles remain in the heel which would otherwise have been removed during the centrifuging and drying steps. With this method larger crystals are obtained which may subsequently have to be ground in order to meet final product crystal size specifications.

The preferred procedure is to add hot syrup on top of the heel. The hot syrup will raise the temperature of the massecuite heel to the estimated saturation temperature (approximately 133° F.) while the feed syrup is cooled to seeding temperature. Some crystal mass is probably lost during this process. Despite that fact, the final seed density should preferably be at least in the range of 2 to 10% (dsb). The critical portion of this operation is the final temperature reached by the feed syrup and the massecuite heel. This should result in supersaturation levels of 1.00 to 1.10. In this range the loss of seed will be minimized and the production of nuclei will be small.

EXAMPLE

A fructose crystallization was conducted using a feed syrup comprising 95.82% (dsb) fructose at 89.60% dry substance in a pilot scale version of a conventional crystallizer. The crystallizer employed had a center shaft agitator. Cooling was achieved through internal fins attached to the center shaft. The crystallizer was nearly filled with 102 gallons of syrup. Cooling was accomplished in about 40 hours from seeding; however, considerable supersaturation (1.17) remained at the end of the period. The batch was monitored by following the change in supersaturation.

Seed was prepared by grinding crystalline product through a 2A Fitzmill screen. The ground material was screened through a 55-mesh screen and through a 100-mesh screen. The seed had a mean size of 161 microns. Dry seed was added directly to the syrup in the crystallizer.

Table IV presents the cooling program actually used during the crystallization. Supersaturation rose during the first 18 hours of the run to a maximum of 1.26. It then dropped to around 1.17 where it remained throughout the remainder of the cool-down.

TABLE IV

| Period (hrs since seeding) | Starting Temp (°F.) | Ending Temp (°F.) | Cooling Rate (°F./hr) |
|---|---|---|---|
| 2.0–10.8 | 133.5 | 122.5 | 1.25 |
| 10.8–20.8 | 122.5 | 111.7 | 0.98 |
| 20.8–30.8 | 111.7 | 100.6 | 1.11 |
| 30.8–40.8 | 100.6 | 86.0 | 1.46 |

The product crystals had a mean size of 268 microns. The crystal yield was 46% based on the fructose content of the syrup.

Separation

A preferred method of separating fructose crystals from the mother liquor is centrifugation in a basket centrifuge. It has been found that about 4 gallons of massecuite in a 14"×6" centrifuge can be separated in about 10–15 minutes. This period includes one to three, typically two, washes with warm water (120°–200° F.). Higher washwater temperatures may result in a greater dissolution of fructose and loss of yield. Recommended washwater amounts are 1–5% based on massecuite charge. Deionized washwater can be used. It is preferred that the pH of the washwater be in the range of about pH 3 to 5.

Preferred operating conditions for a basket centrifuge used to remove crystalline fructose from the mother liquor include: a g force of about 1400, a cake thickness of about 2 to about 3 inches; cake moisture between about 0.7 and about 1.5 percent by water; and a, a product purity above about 99,5%, more preferably above about 99.8%. Cake moisture and purity are believed to be important criteria for producing a nonagglomerated and stable product.

The product cake is preferably washed in the centrifuge prior to removal. A preferred wash is water at a temperature between about 150° and about 180° F. in a quantity of about 1 to about 1.5 percent by weight of the massecuite charged to the centrifuge. Using this method, loss of the product in the wash has typically been found to be about 5 to about 10%. Washwater containing dissolved fructose may be recycled to the carbon treatment step for impurity removal and subsequent reconcentration.

Drying

A variety of dryer types may be employed in the process. Fluidized bed dryers, vibrating fluidized bed dryers, tray and rotary dryers are all suitable. Preferably, wet cake from the centrifuge is metered into a continuous mixer through a variable speed screw conveyor. Dry recycle material is metered in through a choked conveyor (to prevent air bypassing) at a nominal ratio up to 4:1 over the wet cake. Action in the mixer must be sufficient to thoroughly blend the wet and dry materials. The blended cake is then removed to the dryer.

Preferably, the cake is dried cocurrently to avoid overheating the product. Room air should first be cleaned by passage through an ultrafine borosilicate filter rated for 95% removal of 0.5-micron particles. The air is then heated to a temperature which, when mixed with the exhaust air from the cooler, produces 160° F. air at the dryer inlet.

The product leaves the dryer at about 130° F. and is conveyed to the cooler. A controlled amount of the produce is recycled without cooling to the dryer inlet for treating wet centrifuge cake. The most critical variable in dryer operation is moisture of the incoming cake. If the moisture is too high, the dryer will produce balls and agglomerated product. The moisture may be controlled by the ratio of dry recycle to wet cake. Although a 2:1 ratio of dry recycle to wet cake is usually satisfactory for well-developed crystals, nucleated crystals will not centrifuge well and may require a 3:1 ratio to avoid agglomeration.

The centrifuge cake is preferably dried in a rotary dryer to reduce the moisture of the fructose crystals to below about 0.1 percent by weight. It has been found that if the moisture content of the centrifuge cake exceeds approximately 1.5 percent by weight, lumps will form in the dryer. As noted above, dry product recycle may be used to control the centrifuge cake moisture. It is recommended that the product temperature not be allowed to exceed about 140° F. Preferred dryer operating conditions are: an inlet air temperature of about 170° to about 250° F., more preferably about 170° to about 200° F.; an outlet air temperature of about 130° to about 145° F.; a product temperature of about 125° to about 135° F.; and, a product moisture content of less than about 0.1%, more preferably less than about 0.07%.

Conditioning

It has been found that if fructose crystals are stored while still warm they will produce lumps during storage. This same phenomenon exists in dextrose and sucrose production. While the exact mechanism has not been proven, it is contemplated that moisture migration from the large crystals to the smaller ones causes further crystallization at the boundaries. This is the result of either temperature variances or moisture variances, both of which occur because the crystal is not at equilibrium. Tests have shown that drying the product to very low moisture (around 0.05%) and cooling it to room temperature will produce a free-flowing product. To be in equilibrium with fructose crystals having 0.05% moisture, air at 70° must have a relative humidity below 50%.

A rotary cooler with countercurrent air works well for this purpose. Refrigerated, dehumidified (conditioned) air is used to cool the product crystals to below about 75° F., more preferably about 72° F. It is recommended that the inlet cooling air have a temperature below about 70° F. and a relative humidity below about 40%. Retention time in the cooler should be sufficient to assure that the crystals are properly conditioned. The final product moisture content is preferably less than about 0.07%, The final product may be sized by screening and/or grinding. Prolonged storage of product a high temperatures will cause caking and color problems even if it is stored in moisture barrier bags. Warehousing should be done under controlled humidity conditions.

Blending

The mother liquor separated from the crystalline product in the centrifuge may be returned to the EFCS portion of the process.

In addition to mixing dextrose with the mother liquor which remains after separation of the crystalline fructose, the mother liquor may simply be diluted with water to produce a VEFCS.

Following separation of the crystalline fructose, the mother liquor may be mixed with dextrose or dextrose-containing solutions to ultimately produce a liquid-phase sweetener comprising dextrose and fructose such as 55% HFCS (EFCS). As shown in FIG. 3, a number of dextrose-containing streams may be blended with the mother liquor prior to input to the final finishing operations. The choice of particular stream or streams will be dictated by mass balance considerations, the goal being the desired fructose level in the final liquid phase sweetener product. Most commonly for the integrated process this level will be 55% (dsb) fructose. If sufficient fructose is available in the mother liquor, it is even possible to use the dextrose product stream from saccharification (typically 94–96% (dsb) dextrose) to blend for input to EFCS finishing.

Alternatively, the mother liquor which is typically 90–92% (dsb) fructose may simply be diluted with water to produce a liquid-phase sweetener. Dilution is recommended if it is desired to maintain the fructose contained in the mother liquor in the liquid inasmuch as additional fructose would likely crystallize from the mother liquor if the solution is not diluted to below the saturation point for all temperatures likely to be encountered. In addition to water, other suitable diluents include aqueous saccharide solutions such as dextrose syrups, HFCS, EFCS, VEFCS, and production streams for such syrups. Other means for inhibiting the crystallization of fructose in the separated mother liquor include measures for preventing or reducing the evaporation of water from the solution and the incorporation of crystallization-inhibiting additives.

Another use for the separated mother liquor or a portion thereof is production of a non-crystalline or a semi-crystalline fructose sweetener. One way of accomplishing this is to disperse the mother liquor on an edible, particulate solid and then drying the dispersion to produce a sweetener comprising fructose in an amorphous or semi-crystalline form. A preferred edible, particulate solid for this purpose is crystalline fructose.

U.S. Pat. No. 4,517,021 describes a method for producing a semi-crystalline fructose composition. The teachings of this patent are expressly incorporated by reference into this disclosure. The separated mother liquor of the present invention may be used as the aqueous fructose syrup of that process and crystalline fructose may be used as the crystallization initiator. Thus, there is provided an integrated process for the production of crystalline fructose, semi-crystalline fructose, and one or more liquid-phase sweeteners comprising fructose.

The foregoing description has been directed to particular embodiments of the invention in accordance with the requirements of the United States patent statutes for the purpose of illustration and explanation. It will be apparent to those skilled in this area, however, that many modifications and changes in the equipment, compositions and methods set forth will be possible without departing from the scope and spirit of the invention. It is intended that the following claims be interpreted to embrace all such modifications and changes.

What is claimed is:

1. A process for preparing a concentrated solution of fructose comprising:

obtaining a solution of fructose having a fructose concentration of greater than about 75% (dsb) by weight and a dry solids concentration of less than 40%;

contacting said solution with activated carbon to prepare a purified solution of fructose; and evaporating said purified solution to a dry solids concentration of greater than 40%.

2. A process of claim 1 wherein said solution of fructose has a fructose concentration of greater than 90% (dsb) by weight and has a dry solids concentration of less than 35% by weight.

3. A process of claim 1 wherein said solution of fructose has a dry solids concentration of from about 1% to about 25%.

4. A process of claim 1, further comprising crystallizing fructose in said purified solution having a dry solids concentration of greater than 40%.

* * * * *